United States Patent [19]

Neutzer

[11] Patent Number: 5,029,564

[45] Date of Patent: Jul. 9, 1991

[54] FUEL-AIR MIXTURE-FORMING DEVICE FOR INTERNAL COMBUSTION ENGINES

[75] Inventor: Uwe Neutzer, Frankfurt am Main, Fed. Rep. of Germany

[73] Assignee: VDO Adolf Schindling AG, Frankfurt am Main, Fed. Rep. of Germany

[21] Appl. No.: 580,937

[22] Filed: Sep. 10, 1990

[30] Foreign Application Priority Data

Sep. 8, 1989 [DE] Fed. Rep. of Germany ..... 3929838

[51] Int. Cl.[5] ..... F02M 7/00; F02M 9/14; F02M 19/08

[52] U.S. Cl. ..... 123/337; 123/585; 261/44.5

[58] Field of Search ..... 123/337, 445, 531, 585, 123/590; 261/44.5

[56] References Cited

U.S. PATENT DOCUMENTS 4,300,506 11/1981 Knapp et al. ..... 123/337 X 4,955,349 9/1990 Feldinger ..... 123/531

*Primary Examiner*—Tony M. Argenbright

*Attorney, Agent, or Firm*—Martin A. Farber

[57] ABSTRACT

A fuel-air-mixture-forming device for an internal combustion engine, has a nozzle body (2) of rotational symmetry which, together with a throttle body (7) of rotational symmetry which is displaceable in the nozzle body, forms a convergent-divergent nozzle (10) which debouches into an intake pipe of the internal combustion engine. A fuel air slot (11) surrounds the convergent-divergent nozzle and debouches via a circumferential slot opening (12) into the nozzle. Fuel mixed with air is injected from the slot opening into the nozzle via a direction approximately transverse to the direction of the main air mass flow (L). In order to obtain an equalization of the closing forces caused by the vacuum on the throttle body, in accordance with the invention, the throttle body has an inner space (27) which is closed off from the nozzle and is provided with at least one pressure equalization cutout (28) which connects the nozzle with the inner space.

6 Claims, 1 Drawing Sheet

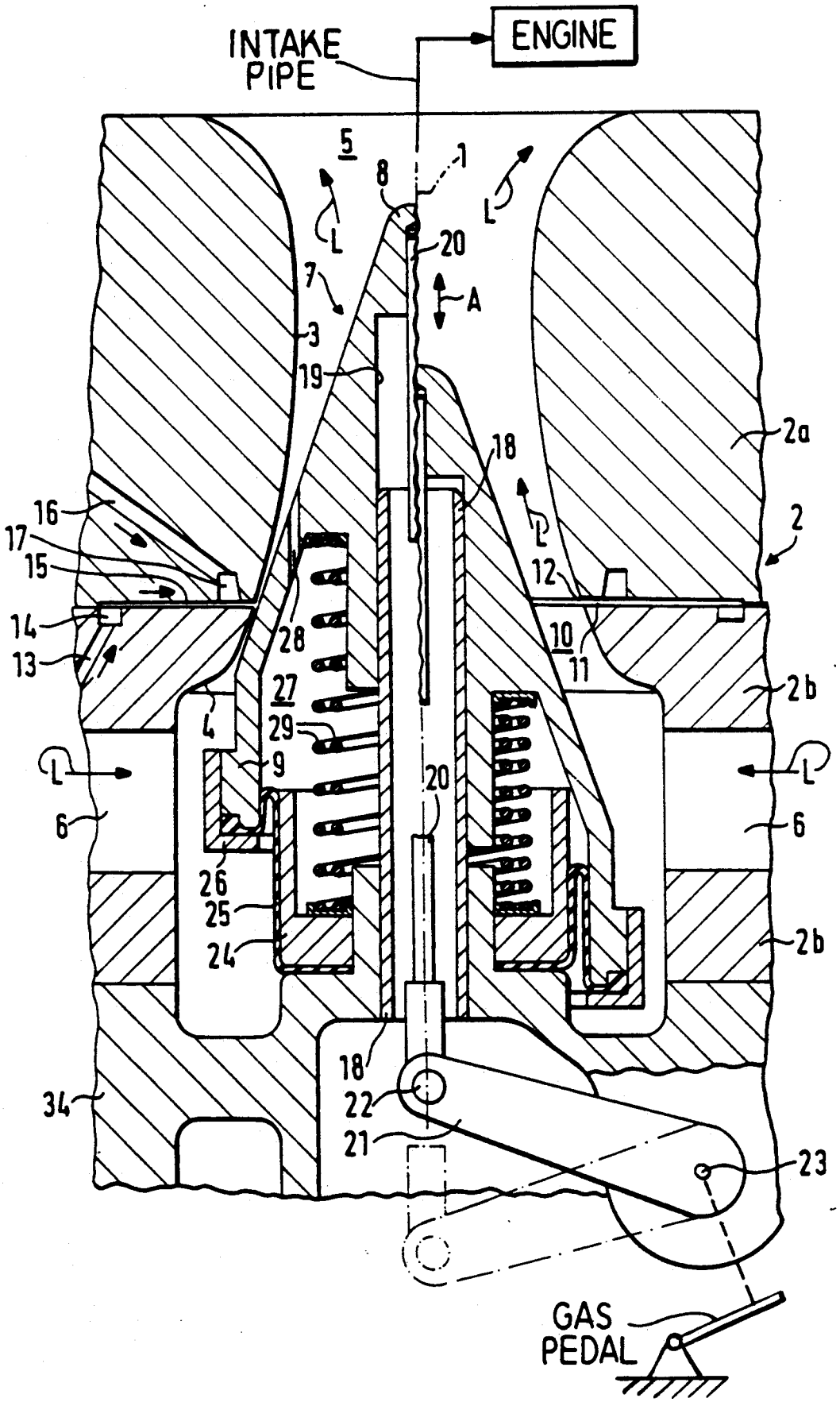
INTAKE PIPE
ENGINE
5
8
1
L
L
20
7
A
3
19
2a
18
16
17
15
L
2
12
14
13
28
10
11
27
29
2b
4
9
L
20
L
6
6
26
25
24
2b
18
22
21
34
23
GAS PEDAL

FUEL-AIR MIXTURE-FORMING DEVICE FOR INTERNAL COMBUSTION ENGINES

FIELD AND BACKGROUND OF THE INVENTION

The present invention relates to a fuel-air-mixture-forming device for an internal combustion engine having a nozzle body of rotational symmetry which together with a throttle body of rotational symmetry which, is displaceable within the nozzle body, forms a convergent-divergent nozzle which debouches into an intake pipe of the internal combustion engine. The device includes a fuel-air slot which surrounds the convergent-divergent nozzle and debouches via a circumferential slot opening into the nozzle. Fuel mixed with air is injected into the nozzle from the slot opening in a direction approximately transverse to the direction of the main air mass flow.

Such a mixture-forming device is known from German patent document 36 43 882 Al. In it, the air mass flow is controlled by means of the throttle body, a greater or lesser vacuum being established in the intake tube and thus at the wall of the throttle body, depending on the state of load of the engine. This vacuum produces on the throttle body closing forces, which must be applied upon the opening of the throttle body.

SUMMARY OF THE INVENTION

It is an object of the invention to develop a mixture-forming device of the foregoing type such that an equalizing of the closing forces produced by the vacuum on the throttle body is obtained.

According to the invention the throttle body (7) has an inner space (27) which is closed off from the nozzle (10) and is provided with at least one pressure equalization cutout (28) which connects the nozzle (10) to the inner space (27).

The pressure present in the region of the nozzle thus passes via the pressure equalization cutout into the closed inner space of the throttle body and, due to its opposite direction of action to the pressure which acts outside the throttle body, effects a compensation of pressure and —depending on the size of the active surface developed in the inner space of the throttle body—an equalization of the closing forces. The size of the active surface should advantageously be so selected that, regardless of the position of installation of the mixture-forming device on the engine, slight closing forces are still present. In this connection, forces introduced into the throttle body by restoring means are possibly also to be taken into account.

In accordance with one particular embodiment of the invention, the throttle body (7) is mounted for axial displacement in the inflow region of the nozzle (10) on a guide element (18) which is mounted concentrically to the nozzle (10) in the housing (34) of the device. The inner space (27) of the hollow throttle body (7) is developed as mounting-side cutout (27) in the throttle body (7), with a sealing element (25) between the throttle body (7) and the housing (34).

A closing-off of the throttle body from the inflow region of the nozzle thus takes place via a separate sealing element which is advantageously developed as roller membrane (25), fold bellows or the like.

Another development provides, in this connection, a setting means (20) for the displacement of the throttle body (7) at least in the direction of opening while at least one spring element (29) is provided for resetting the throttle body (7).

The pressure equalization cutout (28) may advantageously be developed as a pressure-equalization bore hole.

According to a further feature of the invention, the pressure-equalization cutout debouches into the nozzle (10) downstream of the narrowest cross section of the nozzle (10).

Still further according to a feature of the invention, the outer and inner active surfaces of the throttle body (7) are so adapted to each other that small closing forces act on the throttle body (7).

BRIEF DESCRIPTION OF THE DRAWING

With the above and other objects and advantages in view, the present invention will become more clearly understood in connection with the detailed description of a preferred embodiment, when considered with the accompanying drawing, wherein the sole figure is a longitudinal section through the fuel-air-mixture-forming device of the invention for an Otto engine, the figure showing a region of nozzle body and throttle body as well as the associated housing section, the left-hand half of the figure showing the device with the throttle body in the idle position and the right-hand half showing it in the full-load position.

DETAILED DESCRIPTION OF THE PREFERRED EMBODIMENT

In the figure, 1 is an imaginary longitudinal axis of the fuel-air mixture-forming device for the Otto engine around which parts of this mixture-forming device are symmetrically developed. A nozzle body 2 has its inner wall 3 developed substantially with rotational symmetry. The inner space defined by the inner wall within the nozzle body tapers from its lower region 4 continuously upward to a place of narrowest inside cross section. Adjoining this in upward direction there is a diffuser 5 which debouches into an intake pipe (indicated diagrammatically) of the internal combustion engine. At the bottom, the fuel-air-mixture-forming device is acted on by air, an air filter, also not shown, through the openings 6. The main air mass flow therefore flows in upward direction as indicated by the arrow L.

A throttle body 7 which is also formed with rotational symmetry around the longitudinal axis serves, in combination with the nozzle body 2, for regulating the main air mass flow L, the throttle body being adjustable for this purpose in the direction of the longitudinal axis as indicated by the double-ended arrow A. The throttle body 7 is developed substantially as a cone with upward-directed tip 8; at its bottom it furthermore has a cylindrical extension 9. The nozzle body 2 together with the throttle body 7 forms a convergent-divergent nozzle 10 having a variable narrowest cross-section due to the possibility of displacing the throttle body 7.

The nozzle body 2 is divided in the region of the variable narrowest nozzle cross-section into an upper nozzle-body part **2*a* and a lower nozzle-body part 2*b*. Between them there is formed a fuel-air slot 11 which surrounds the nozzle 10 and debouches via a surrounding slot opening 12 into the nozzle 10. Fuel mixed with air is injected into the nozzle 10 from the slot opening approximately transverse to the direction of the main air mass flow L. For the feeding of fuel into the inside of the nozzle body 2, the lower nozzle-body part 2*b* is provided with a fuel feed bore hole 13 which passes into a fuel annular channel 14 which is arranged in the nozzle-body part 2b with rotational symmetry to the longitudinal axis 1, said channel debouching into the fuel-air slot 11 via a fuel slot 15 which is connected with it. The feeding of the air is effected via at least one bore hole 16 in the upper nozzle-body part 2a which debouches into an air annular channel 17 which is also arranged with rotational symmetry with respect to the longitudinal axis 1 and is in communication with the fuel-air slot 11**.

The guiding of the throttle body 7 is effected via a guide tube 18 which is arranged concentrically to the longitudinal axis 1 and is firmly attached to a housing part 34 which receives the nozzle body 2, which part is located below the throttle body 7 and the openings 6 for the main air mass flow L and is part of the housing of the mixture-forming device. In detail, the housing part 34 is provided with a bore which is arranged concentrically to the longitudinal axis 1 and into which the guide tube 18 is pressed. The conically tapering half of the throttle body 7 is provided with a corresponding bore 19 which is passed through by the guide tube 18 in such a manner that the throttle body 7 can be displaced on the guide tube 18 between the two positions shown. In the region of the tip 8, the throttle body 7, starting from the bore 19, has a central bore into which a rod 20 of soft flexibility is inserted and soldered to the throttle body 7. The end of the rod 20 facing away from the tip 8 of the throttle body 7 is pivotally connected to a lever 21 which is swingably mounted in the housing part 34 below an exit opening of the guide tube 18, spaced from the longitudinal axis 1. The points of attachment of rod 20 and lever 21 and of lever 21 and housing part 34 are designated by the reference numbers 22 and 23. The development of the device described thus makes possible axial displacement of the throttle body 7 on the guide tube 18 by means of the rod 20 which is firmly attached to the throttle body 7 and is actuated by the lever 21 via means of force from a gas pedal indicated diagrammatically.

As can also be noted from the figure, the housing part 34 is provided, concentrically to the longitudinal axis 1 and spaced from the guide tube 18, with a flange element 24 which in every operating position of the throttle body 7 covers the inside of its cylindrical extension 9. Between the flange element 24 and the housing part 34 there is clamped one end of a roller membrane 25 the other end of which is fixed between the cylindrical extension 9 and a clamping ring 26 which surrounds it. A bore hole 28 is arranged in the conical region of the throttle body 7 and debouches into the inner space 27 of the throttle body 7. The sealing of the lower, open end of the throttle body 7 by means of the roller membrane 25 serves, in cooperation with the bore hole 28, for the relieving of the throttle body 7 of pressure upon the variable closing forces produced by the vacuum in the system. The bore hole 28 thus effects a pressure equalization between the nozzle 10 and the inner space 27 of the throttle body 7. The corresponding pressure-force-transmitting surfaces projected in the directions of the arrow A are, in this connection, so adapted to each other that, solely upon consideration of pressure-equalization, only slight closing forces act on the throttle body 7. Due to the variable pressure conditions as a function of the state of load of the internal combustion engine, a summary consideration is to be made upon the dimensioning the active surface and the arrangement of the pressure-equalization bore hole 28. In the present case, the inner diameter of the cylindrical extension 9 corresponds approximately to the inner diameter of the nozzle body 2 in the region of the slot opening 2, and the bore 28 debouches into the nozzle 10 at a distance from the longitudinal axis 1 which corresponds approximately to the smallest distance of the nozzle body 2 from the longitudinal axis 1.

Finally two redundant springs 29 are provided, arranged within the throttle body 7, which springs rest, on the one end, against the inside of the throttle body 7 and, on the other end, against the flange element 24, and therefore insure that, upon the release of a gas pedal, the amount of mixture which is made available to the Otto engine by the mixture-forming device is reduced corresponding to the position of the gas pedal.

I CLAIM:

1. A fuel-air-mixture-forming device for an internal combustion engine, the device comprising:

a nozzle body of rotational symmetry and a throttle body of rotational symmetry which is displaceable within the nozzle body, the nozzle body and the throttle body forming a convergent-divergent nozzle which debouches into an intake pipe of the internal combustion engine;

a fuel-air slot which surrounds the convergent-divergent nozzle, is located in the nozzle body, and debouches via a circumferential slot opening into the nozzle; and wherein fuel mixed with air is injected into the nozzle from the slot opening in a direction approximately transverse to the direction of the main air mass flow;

the throttle body has an inner space which is closed off from the nozzle; and the throttle body is provided with at least one pressure equalization cutout which connects the to the inner space of the throttle body.

2. A mixture-forming device according to claim 1, further comprising a housing, a guide element which is mounted in the housing concentrically to the nozzle, and a element located between the throttle body and the housing; and wherein the throttle body is mounted for axial displacement in an inflow region of the nozzle on the guide element, the inner space of the throttle body being developed as mounting-side cutout in the throttle body.

3. A mixture-forming device according to claim 2, wherein the sealing element is developed as a roller membrane.

4. A mixture-forming device according to claim 2, wherein the sealing element developed as a fold bellows.

5. A mixture-forming device according to claim 1, wherein the pressure-equalization cutout debouches into the nozzle downstream of a narrowest cross section of the nozzle.

6. A mixture-forming device according to claim 1, wherein outer and inner active surfaces of the throttle body are adapted to each other to reduce closing forces which act on the throttle body.

* * * * *